US008421733B2

(12) United States Patent
Lee et al.

(10) Patent No.: US 8,421,733 B2
(45) Date of Patent: Apr. 16, 2013

(54) LIQUID CRYSTAL DISPLAY AND METHOD OF DRIVING THE SAME

(75) Inventors: Joo-Hyung Lee, Gwacheon-si (KR); Sang-Jin Pak, Yongin-si (KR); Young-Ok Cha, Gwangmyeong-si (KR)

(73) Assignee: Samsung Display Co., Ltd. (KR)

( * ) Notice: Subject to any disclaimer, the term of this patent is extended or adjusted under 35 U.S.C. 154(b) by 946 days.

(21) Appl. No.: 12/501,722

(22) Filed: Jul. 13, 2009

(65) Prior Publication Data

US 2010/0007597 A1 Jan. 14, 2010

(30) Foreign Application Priority Data

Jul. 11, 2008 (KR) ..... 10-2008-0067722

(51) Int. Cl.
*G09G 3/36* (2006.01)

(52) U.S. Cl.
USPC ..... 345/99; 345/89

(58) Field of Classification Search ..... None
See application file for complete search history.

(56) References Cited

U.S. PATENT DOCUMENTS

2002/0033789 A1* 3/2002 Miyata et al. ..... 345/89
2007/0195046 A1* 8/2007 Cho ..... 345/98

FOREIGN PATENT DOCUMENTS

JP 2004294991 10/2004
JP 2008009251 1/2008
KR 1020020044672 6/2002

* cited by examiner

*Primary Examiner* — Joseph Haley
*Assistant Examiner* — Nicholas Lee
(74) *Attorney, Agent, or Firm* — Cantor Colburn LLP

(57) ABSTRACT

A liquid crystal display includes a liquid crystal panel, a timing controller which receives previous image data and current image data, the timing controller may correct the current image data according to a reference bit of conversion image data generated using the previous image data, and outputs a display image signal to the liquid crystal panel. The liquid crystal panel further includes a data driver which receives the display image signal and applies a data voltage corresponding to the display image signal to the liquid crystal panel.

19 Claims, 8 Drawing Sheets

FIG. 6

| Gn' | | Gn-1 | | | | | | | |
|---|---|---|---|---|---|---|---|---|---|
| | | 0 | 8 | 16 | 24 | 32 | 40 | 48 | 56 |
| Gn | 8 | | | | | | | | |
| | 16 | | | | | | | | |
| | 24 | | | | | | II | | |
| | 32 | | | | | | | | |
| | 40 | | | | | | | | |
| | 48 | | | | | | | | |
| | 56 | | | | | | | | |
| | 64 | | | I | | | | | |
| | ⋮ | | | | | | | | |
| | 96 | | | | | | | | |
| | 128 | | | | | | | | |

LIQUID CRYSTAL DISPLAY AND METHOD OF DRIVING THE SAME

This application claims priority to Korean Patent Application No. 10-2008-0067722, filed on Jul. 11, 2008, and all the benefits accruing therefrom under 35 U.S.C. §119, the contents of which in its entirety are herein incorporated by reference.

BACKGROUND OF THE INVENTION

1. Field of the Invention

The present invention relates to a liquid crystal display ("LCD") and a method of driving the same.

2. Description of the Related Art

A liquid crystal display ("LCD") includes an LCD panel, which in turn includes a first display substrate having a plurality of pixel electrodes, a second display substrate having a plurality of common electrodes, and a dielectrically anisotropic liquid crystal layer injected between the first and second display substrates. The response time of liquid crystals affects the display quality of an LCD. Therefore, a driving method in which an image of a previous frame is compared to an image signal of a current frame to correct the image signal of the current frame has recently been suggested.

In order to correct the image signal of the current frame as described above, a memory for storing the image signal of the previous frame is required. As the display quality of the LCD improves, the number of bits of the image signal of the previous frame is increased. Hence, the size of the memory must be increased, which results in an increase in the power consumption and manufacturing costs of the LCD.

BRIEF SUMMARY OF THE INVENTION

Exemplary embodiments of the present invention provide a liquid crystal display ("LCD") which can minimize an increase in the power consumption and manufacturing costs thereof.

Exemplary embodiments of the present invention also provide a method of driving an LCD, the method capable of minimizing an increase in the power consumption and manufacturing costs of the LCD.

Exemplary embodiments of the present invention are not restricted to the one set forth herein. The above and other exemplary embodiments of the present invention will become more apparent to one of ordinary skill in the art to which the present invention pertains by referencing the detailed description of the present invention given below.

According to an exemplary embodiment of the present invention, an LCD includes; a liquid crystal panel, a timing controller which receives previous image data and current image data, corrects or does not correct the current image data according to a reference bit of conversion image data generated using the previous image data, and outputs a display image signal to the liquid crystal display, and a data driver which receives the display image signal and applies a data voltage corresponding to the display image signal to the liquid crystal panel.

According to another exemplary embodiment of the present invention, an LCD includes; a liquid crystal panel, a timing controller which receives previous image data and current image data, corrects or does not correct the current image data according to a reference bit of conversion image data generated using the previous image data, and outputs a display image signal to the liquid crystal panel, wherein the conversion image data is updated when the current image data is different from the previous image data and is not updated when the current image data is substantially identical to the previous image data, and a data driver which receives the display image signal and applies a data voltage corresponding to the display image signal to the liquid crystal panel.

According to another exemplary embodiment of the present invention, a method of driving an LCD includes; receiving conversion image data, which is generated by using previous image data, and current image data, outputting a display image signal which is generated by correcting or not correcting the current image data according to a reference bit of the conversion image data, and applying a data voltage corresponding to the display image signal to a liquid crystal panel and displaying an image corresponding to the data voltage on the liquid crystal panel.

BRIEF DESCRIPTION OF THE DRAWINGS

The above and other aspects and features of the present invention will become more apparent by describing in detail exemplary embodiments thereof with reference to the attached drawings, in which:

FIG. 6 is an example of a lookup table ("LUT") included in the exemplary embodiment of a timing controller of FIG. 5;

DETAILED DESCRIPTION OF THE INVENTION

Figure 1:
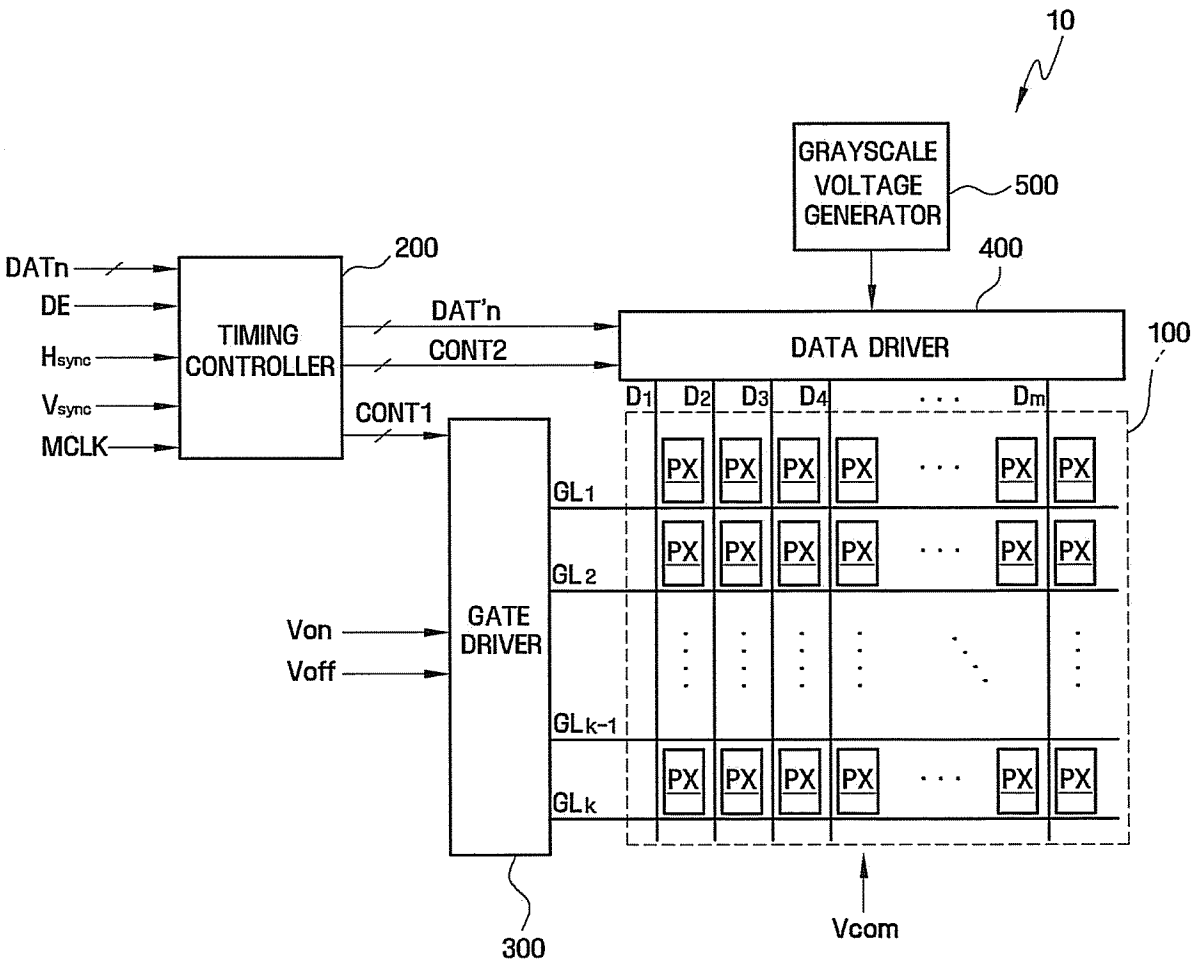
FIG. 1 is a block diagram of an exemplary embodiment of a liquid crystal display ("LCD") according to the present invention.

The invention now will be described more fully hereinafter with reference to the accompanying drawings, in which embodiments of the invention are shown. This invention may be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, groups, components, steps, operations, and/or elements, but do not preclude the presence or addition of one or more other features, regions, integers, components, steps, operations, elements, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, when the device in one of the figures is turned over, elements described as being on the "lower" side of other elements would then be oriented on "upper" sides of the other elements. The exemplary term "lower", can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments of the present invention are described herein with reference to cross section illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

As used herein, the terms "rows" and "columns" of a matrix may be changed to "columns" and "rows" depending on an observer's point of view. That is, "rows" may be replaced by "columns" and vice versa.

Hereinafter, exemplary embodiments of a liquid crystal display ("LCD") and exemplary embodiments of a method of driving the same according to the present invention will be described.

Figure 2:
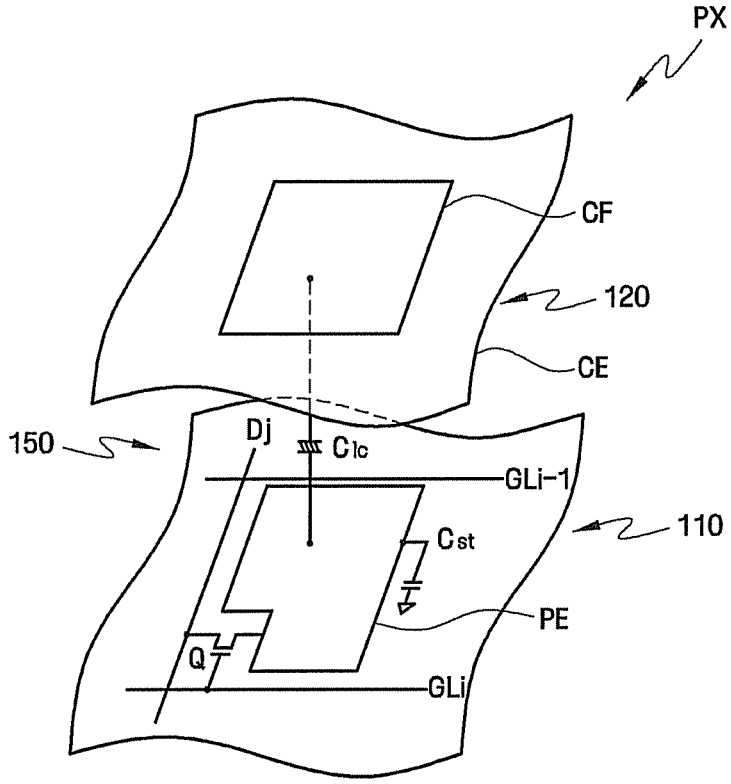
FIG. 2 is an equivalent circuit diagram of an exemplary embodiment of a pixel included in the exemplary embodiment of an LCD of FIG. 1.
Figure 3:
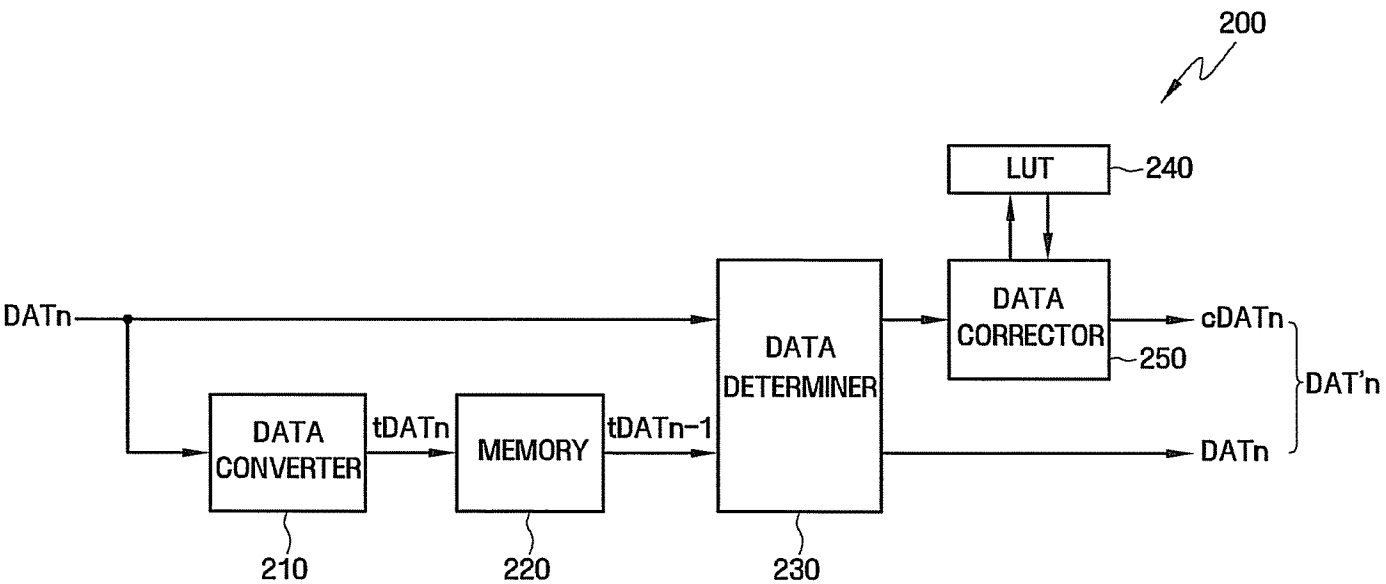
FIG. 3 is a block diagram of an exemplary embodiment of a timing controller included in the exemplary embodiment of an LCD of FIG. 1.
Figure 4:
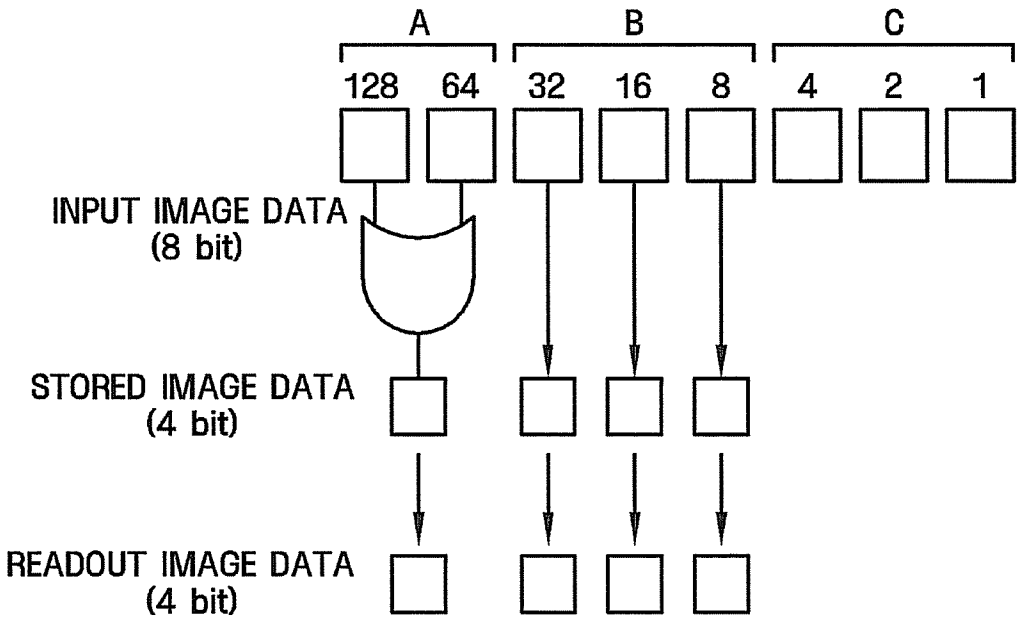
FIG. 4 is a conceptual diagram illustrating an exemplary embodiment of a data conversion process performed by an exemplary embodiment of a data converter illustrated in FIG. 3.

An exemplary embodiment of an LCD and an exemplary embodiment of a method of driving the same according to the present invention will be described with reference to FIGS. 1 through 4. FIG. 1 is a block diagram of an LCD 10 according to an exemplary embodiment of the present invention. FIG. 2 is an equivalent circuit diagram of an exemplary embodiment of a pixel PX included in the LCD 10 of FIG. 1. FIG. 3 is a block diagram of an exemplary embodiment of a timing controller 200 included in the LCD 10 of FIG. 1. FIG. 4 is a conceptual diagram illustrating an exemplary embodiment of a data conversion process performed by an exemplary embodiment of a data converter 210 illustrated in FIG. 3

Referring to FIG. 1, the LCD 10 includes a liquid crystal panel 100, a gate driver 300, a data driver 400, and the timing controller 200. The liquid crystal panel 100 includes a plurality of display signal lines and a plurality of pixels PX which are arranged in a matrix and connected to the display signal lines. Referring to FIG. 2, the liquid crystal panel 100 may include a first display substrate 110, a second display substrate 120 which faces the first display substrate 110, and liquid crystals 150 which are interposed between the first and second display substrates 110 and 120.

The display signal lines include a plurality of gate lines GL1 through GLk which deliver gate signals and a plurality of data lines D1 through Dm which deliver data signals. The gate lines GL1 through GLk extend in a substantially row direction to be substantially parallel to each other. The data lines D1 through Dm extend in a substantially column direction to be substantially parallel to each other.

As described above, FIG. 2 is an equivalent circuit diagram of one of the pixels PX illustrated in FIG. 1. Referring to FIG. 2, in one exemplary embodiment, a color filter CF may be formed on a portion of a common electrode CE of the second display substrate 120 to face a pixel electrode PE of the first display substrate 110. Each of the pixels PX, for example, a pixel PX connected to an $i^{th}$ (wherein i is an integer from 1 to n) gate line GLi and a $j^{th}$ (wherein j is an integer from 1 to m) data line Dj, may include a switching device Q, which is connected to the $i^{th}$ gate line GLi and the $j^{th}$ data line Dj, and a liquid crystal capacitor Clc and a storage capacitor Cst which are connected to the switching device Q.

Referring again to FIG. 1, the timing controller 200 receives input control signals, e.g., from an external graphic controller (not shown), and generates a gate control signal CONT1 and a data control signal CONT2 based on the received input control signals. Then, the timing controller 200 transmits the gate control signal CONT1 to the gate driver 300 and the data control signal CONT2 to the data driver 400. Exemplary embodiments of the input control signals include a vertical synchronization signal Vsync, a horizontal synchronization signal Hsync, a main clock signal Mclk, and a data enable signal DE.

In addition, the timing controller 200 receives previous image data $DAT_{n-1}$ (as will be discussed in more detail below with reference to FIG. 3) and current image data DATn. Then, the timing controller 200 corrects or does not correct the current image data DATn according to a reference bit of conversion image data $tDAT_{n-1}$ (as will be discussed in more detail below with reference to FIG. 3), which has been generated by using the previous image data $DAT_{n-1}$, and outputs a display image signal DAT'n. In one exemplary embodiment, the previous image data $DAT_{n-1}$ and the current image data DATn may correspond to successive frames, respectively. In some alternative exemplary embodiments, the previous image data $DAT_{n-1}$ and the current image data DATn may correspond respectively to frames which are several frames apart from each other.

The display image signal DAT'n is a signal obtained by correcting or not correcting the current image data DATn according to the reference bit of the conversion image data $tDAT_{n-1}$. That is, the reference bit of the conversion image data $tDAT_{n-1}$ may determine whether to correct the current image data DATn. In addition, in one exemplary embodiment, the reference bit of the conversion image data $tDAT_{n-1}$ may be an upper bit of the conversion image data $tDAT_{n-1}$.

When the signal, which is obtained by correcting the current image data DATn, is to be output as the display image signal DAT'n, the display image signal DAT'n may be generated by using a correction value which corresponds to the conversion image data $tDAT_{n-1}$ and the current image data DATn. The timing controller 200 may include a lookup table ("LUT") which stores correction values corresponding to combinations of the conversion image data $tDAT_{n-1}$ and the current image data DATn. The timing controller 200 will be described in more detail later.

The gate control signal CONT1 is used to control the operation of the gate driver 300. In on exemplary embodiment, the gate control signal CONT1 may include a vertical start signal for starting the gate driver 300, a gate clock signal for determining when to output a gate-on voltage Von, and an output enable signal for determining the pulse width of the gate-on voltage Von.

The data control signal CONT2 is used to control the operation of the data driver 400. In one exemplary embodiment, the data control signal CONT2 may include a horizontal start signal for starting the data driver 400 and an output instruction signal for instructing the output of two data voltages.

The gate driver 300 receives the gate control signal CONT1 from the timing controller 200 and transmits a gate signal to each of the gate lines GL1 through GLk. The gate signal includes the gate-on voltage Von and a gate-off voltage Voff, which, in one exemplary embodiment, may be provided by a gate on/off voltage generator (not shown).

The data driver 400 receives the data control signal CONT2 from the timing controller 200 and applies an image data voltage to each of the data lines D1 through Dm. The image data voltage may be a grayscale voltage which is provided by a grayscale voltage generator 500 and corresponds to the display image signal DAT'n.

Referring to FIG. 3, the timing controller 200 includes a data converter 210, a memory 220, a data determiner 230, the LUT 240, and a data corrector 250.

In the present exemplary embodiment, both the previous image data $DAT_{n-1}$ and the current image data DATn are divided into a plurality of groups, each group having one or more bits. Any one of the groups may include one or more original reference bits which are converted into a reference bit. Each of the previous image data $DAT_{n-1}$ and the current image data DATn may be divided into first through third groups. In the exemplary embodiment wherein each of the previous image data $DAT_{n-1}$ and the current image data DATn is an 8-bit signal, the first group of each of the previous image data $DAT_{n-1}$ and the current image data DATn may include 2 bits, the second group may include 3 bits, and the third group may include 3 bits, in order of most significant bit ("MSB") to least significant bit ("LSB").

Similarly, in the exemplary embodiment wherein the previous image data $DAT_{n-1}$ and the current image data DATn is a 6-bit signal, each of the first through third groups of the previous image data $DAT_{n-1}$ and the current image data DATn may include 2 bits. The above cases are merely exemplary embodiments and the image data may have other bit sizes, e.g., 64, 128, etc., and may be divided into groups having different numbers of bits as would be apparent to one of ordinary skill in the art.

One or more original reference bits included in each of the previous image data $DAT_{n-1}$ and the current image data DATn may be upper bits, e.g., the first group. For example, when the previous image data $DAT_{n-1}$ is an 8-bit signal, 2 MSBs of the previous image data $DAT_{n-1}$ may be original reference bits. Thus, upper bits of the conversion image data $tDAT_n$ which is generated by using the current image data $DAT_n$ may include a reference bit.

The data converter 210 converts the current image data $DAT_n$ into the conversion image data $tDAT_n$. The conversion image data $tDAT_n$ may be a signal having a smaller number of bits than the current image data $DAT_n$. The conversion image data $tDAT_n$ may be a signal obtained by combining bits in the first group of the previous image data $DAT_n$, maintaining bits in the second group as they are, and removing bits in the third group. For example, when the current image data $DAT_n$ is an 8-bit signal, upper 2 bits in the first group of the current image data $DAT_n$ may be combined into 1 bit, 3 bits in the second group may be maintained unchanged, and 3 bits in the third group may be removed. Consequently, the 8-bit current image data $DAT_n$ may be converted into the 4-bit conversion image data $tDAT_n$. Here, a reference bit of the 4-bit current image data $DAT_n$ is one MSB.

The memory 220 stores the conversion image data $tDAT_n$. Since the number of bits of the conversion image data $tDAT_n$ is smaller than that of bits of the current image data $DAT_n$, the size of the memory 220 can be reduced when the conversion image data $tDAT_n$ is stored in the memory 220 as compared to when the current image data $DAT_n$ were to be stored in the memory 220.

A method of converting image data by using the data converter 210 will now be described with reference to FIG. 4. FIG. 4 illustrates an 8-bit image data which is divided into a first group A of 2 bits, a second group B of 3 bits, and a third group C of 3 bits. This is just one exemplary embodiment, and the present invention is not limited thereto.

When the 8-bit image data divided into the first through third groups A through C is input to the data converter 210, the data converter 210 performs a data conversion process, which corresponds to each of the first through third groups A through C, in order to convert the input 8-bit image data into 4-bit conversion image data $tDAT_n$.

The 2 bits in the first group A of the input 8-bit image data may be combined into 1 bit. Here, in one exemplary embodiment, an OR gate may be used. That is, when the first group A consists of binary bits "00", those bits "00" may be combined into a single bit "0". When the first group A consists of binary bits "01," "10," or "11" which is different from "00," those bits "01," "10," or "11" maybe combined into a single bit "1". Therefore, the bit "0" or "1" into which the 2 bits in the first group A are combined may be a reference bit of the conversion image data $tDAT_n$ which determines whether to correct the current image data DATn, i.e., the input 8-bit image data, as will be discussed in more detail below.

The second group B of the input 8-bit image data may be maintained unchanged, and the third group C may be removed. That is, the 2 bits in the first group A of the input 8-bit image data may be combined into one bit, the 3 bits in the second group B may be maintained unchanged, and the 3 bits in the third group C may be removed to generate the 4-bit conversion image data $tDAT_n$.

The 4-bit conversion image data $tDAT_n$, which has been reduced from the input 8-bit image data, may be stored in the memory 220. As described above, since the number of bits of the conversion image data $tDAT_n$ is smaller than that of bits of the input image data, the size of the memory 220 can be reduced when the conversion image data $tDAT_n$ is stored in the memory 220 as compared to when the input image data were to be stored in the memory 220.

The conversion image data $tDAT_{n-1}$ from a previous frame which has been previously stored in the memory 220 is output to the data determiner 230 (see FIG. 3) upon the entry of the conversion image data $tDAT_n$ of the current frame into the memory 220. The conversion image data $tDAT_{n-1}$ (e.g., read-out image data) output from the memory 220 to the data determiner 230 may have 4 bits as shown in FIG. 4. In some exemplary embodiments, after the 4-bit conversion image data $tDAT_{n-1}$ is output from the memory 221, it may be converted into 8-bit image data. For example, when the conversion image data $tDAT_{n-1}$ stored in the memory 220 has 4 bits, e.g., "0101," it maybe output to the data determiner 230 as it is (e.g., as a 4-bit signal "0101"). Alternative exemplary embodiments include configurations wherein, the reference bit "0" of the conversion image data $tDAT_{n-1}$ may be converted into "00", and "000" may be added in place of the removed lower 3 bits of the third group C. In this alternative exemplary embodiment, the conversion image data $tDAT_{n-1}$ "0101" may be converted into "00101000" and sent accordingly to the data determiner 230.

The present exemplary embodiment will be described below based on the exemplary embodiment wherein the conversion image data $tDAT_{n-1}$ consists of 4 bits. The present exemplary embodiment may be modified appropriately and applied to a case where the 4-bit conversion image data $tDAT_{n-1}$ is converted into 8-bit conversion image data $tDAT_{n-1}$ and sent accordingly.

Referring back to FIG. 3, the data determiner 230 receives the conversion image data $tDAT_{n-1}$ and the current image data DATn and determines whether to correct the current image data DATn. As described above, whether to correct the current image data DATn may be determined by the value of the reference bit of the conversion image data $tDAT_{n-1}$. That is, when the reference bit of the conversion image data $tDAT_{n-1}$ has a first binary value, the data determiner 230 outputs the current image data DATn to the data driver 400 (see FIG. 1) without conversion. When the reference bit of the conversion image data $tDAT_{n-1}$ has a second binary value, which is different from the first binary value, the data determiner 230 outputs the current image data DATn to the data corrector 250 to correct the current image data DATn. In one exemplary embodiment, the first binary value maybe "0," and the second binary value maybe "1."

In one exemplary embodiment, the reference bit may be the MSB of the conversion image data $tDAT_{n-1}$. For example, when the conversion image data $tDAT_{n-1}$ is "0101," its reference bit is "0." Accordingly, the data determiner 230 provides the current image data DATn to the data driver 400 as it is. On the contrary, when the conversion image data $tDAT_{n-1}$ is "1101," its reference bit is "1." Accordingly, the data determiner 230 outputs the current image data DATn to the data corrector 250 to correct the current image data DATn.

The data corrector 250 corrects the current image data DATn received from the data determiner 230 and outputs the corrected, current image data cDATn as the display image signal DAT'n. The display image signal DAT'n output from the data corrector 250 may be transmitted to the data driver 400. Then, the data driver 400 may apply a data voltage corresponding to the received display image signal DAT'n to the liquid crystal panel 100, so that an image corresponding to the display image signal DAT'n can be displayed on the liquid crystal panel 100. Here, the display image signal DAT'n may be a signal generated by using a correction value which corresponds to the conversion image data $tDAT_{n-1}$ and the current image data DATn.

The LUT 240 stores correction values corresponding to combinations of the conversion image data $tDAT_{n-1}$ and the current image data DATn. Since the conversion image data $tDAT_{n-1}$ excludes the third group of the previous image data $DAT_{n-1}$, it may have a discontinuous grayscale depending on the number of bits in the third group. That is, since the 4-bit conversion image data $tDAT_{n-1}$ to which the 8-bit previous image data $DAT_{n-1}$ has been reduced excludes the lower 3 bits in the third group, it may have a grayscale of, for example, 0, 8, 16, 24, 32, 40, 48, and 56. Information contained in the original 8-bit signal has been lost due to the conversion to the 4-bit signal, and therefore it is capable of corresponding to a reduced number of grayscales as compared to the previous 8-bit signal. Since the current image data DATn, which has not been converted, is an 8-bit signal, it may have a continuous grayscale of 0 to 255. Thus, the LUT 240 may include correction values corresponding to all combinations of gray levels of the conversion image data $tDAT_{n-1}$ and those of the current image data DATn.

In some embodiments, the LUT 240 may store correction values corresponding to combinations of the discontinuous grayscale of the conversion image data $tDAT_{n-1}$ and a reference grayscale of the current image data DATn, so that the current image data DATn can be corrected more efficiently in terms of processing time by the data corrector 250 and storage space in the LUT 240. Here, the reference grayscale may denote a grayscale corresponding to bit values of the first and second groups of the current image data DATn. For example, when the current image data DATn is an 8-bit signal and when its first through third groups include 2 bits, 3 bits and 3 bits, respectively, in order of MSB to LSB, a grayscale corresponding to the bit values of the first and second groups may be a grayscale corresponding to upper 5 bits which exclude the 3 bits in the third group, that is, may be a grayscale of 0, 8, 16, 24, 32, 40, . . . , 255.

The current image data DATn corresponding to the remaining gray levels may be corrected by using correction values corresponding to combinations of the discontinuous grayscale of the conversion image data $tDAT_{n-1}$ and the reference grayscale of the current image data DATn by using the remaining bits of the current image data DATn, that is, the 3 bits in the third group. In one exemplary embodiment, the current image data DATn may be corrected by interpolation.

Accordingly, the data converter 210 generates the conversion image data $tDAT_n$ by using the current image data $DAT_n$ and stores the conversion image data $tDAT_n$ in the memory 220, then a conversion image data $tDAT_{n-1}$, which has been previously stored in the memory 220, is output from the memory 220, the data determiner 230 receives the conversion image data $tDAT_{n-1}$ and the current image data DATn, corrects or does not correct the current image data DATn according to the reference bit of the conversion image data $tDAT_{n-1}$, and outputs the display image signal DAT'n. Then, a data voltage corresponding to the display image signal DAT'n is applied to the liquid crystal panel 100, so that an image corresponding to the display image signal DAT'n can be displayed on the liquid crystal panel 100. When the reference bit of the conversion image data $tDAT_{n-1}$ has the first binary value, the current image data DATn may be output to the data driver 400 without being corrected. When the reference bit has the second binary value, the current image data DATn may be output to the data corrector 250 to be converted prior to being used as the display image signal DAT'n.

In the LCD 10 and the method of driving the same according to the present embodiment, the current image data $DAT_n$ is converted into the conversion image data $tDAT_n$ having a smaller number of bits than that of the current image data $DAT_n$, and the conversion image data $tDAT_n$ is stored. Therefore, the size of the memory 220 which is to store the current image data $DAT_n$ can be reduced. In addition, since the current image data DATn is selectively corrected according to the reference bit of the conversion image data $tDAT_{n-1}$, the power consumed to correct the current image data DATn can be reduced.

Figure 5:
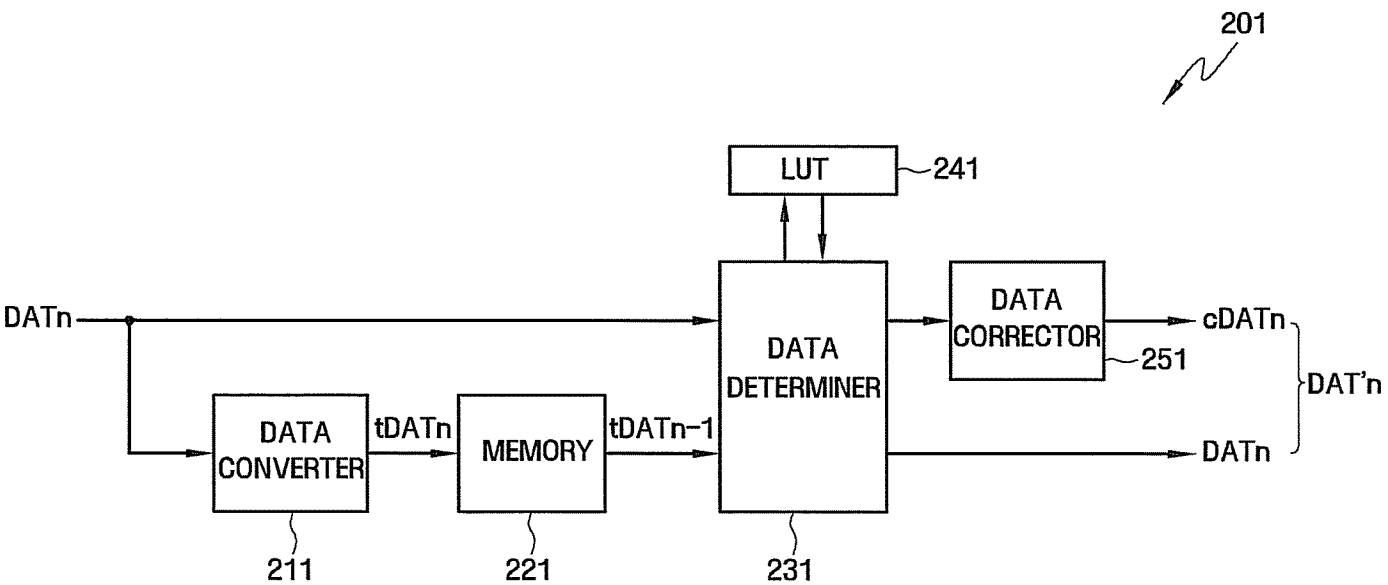
FIG. 5 is a block diagram of another exemplary embodiment of a timing controller included in an exemplary embodiment of an LCD according to the present invention.

Hereinafter, another exemplary embodiment of an LCD and another exemplary embodiment of a method of driving the same according to the present invention will be described with reference to FIGS. 5 and 6. FIG. 5 is a block diagram of another exemplary embodiment of a timing controller 201 included in another exemplary embodiment of an LCD according to the present invention. FIG. 6 is an example of an LUT 241 included in the timing controller 201 of FIG. 5.

The LCD and the method of driving the same according to the present exemplary embodiment is different from those according to the previous exemplary embodiment in that whether to correct current image data DATn is determined based on combinations of conversion image data $tDAT_{n-1}$ and the current image data DATn. Elements substantially identical to those of the previous embodiment are indicated by like reference numerals, and thus their description will be omitted.

Referring to FIG. 5, the present exemplary embodiment of an LCD includes the timing controller 201, a data converter 211, a memory 221, a data determiner 231, the LUT 241, and a data corrector 251.

As described above, the data converter 211 generates the conversion image data $tDAT_n$ by using current image data $DAT_n$, and the generated conversion image data $tDAT_n$ is stored in the memory 221. The memory may then output a conversion image data $tDAT_{n-1}$ corresponding to a previous frame.

The LUT 241 may include a first region "I" and a second region "II." The first region "I" includes correction values corresponding to combinations of the conversion image data $tDAT_{n-1}$ and the current image data DATn. The second region "II" does not include the correction values corresponding to the combinations of the conversion image data $tDAT_{n-1}$ and the current image data DATn. In FIG. 6, a brightly-shaded region is the first region "I", and a darkly-shaded region is the second region "II", and Gn', Gn and Gn−1 represent the gray level corresponding to the combined image data, the gray level corresponding to the current image data, and the gray level corresponding to the conversion image data, respectively.

The first region "I" includes the corrections values corresponding to the combinations of the conversion image data tDATn−1 and the current image data DATn, wherein gray levels of the current image data DATn are greater than those of the conversion image data $tDAT_{n-1}$ and are equal to or less than a predetermined gray level. The predetermined gray level may be a value that obtained the minimum response time required by a product when the response times of liquid crystals for the previous image data $DAT_{n-1}$ and the current image data DATn were measured. For example, when the current image data DATn has 8 bits, the predetermined gray level may be equal to or greater than a gray level of 128.

The second region "II" does not include the correction values corresponding to the combinations of the conversion image data $tDAT_{n-1}$ and the current image data DATn. The second region "II" may include those combinations of the conversion image data $tDAT_{n-1}$ and the current image data DATn, which are not included in the first region "I", in addition to the dark region in FIG. 6.

Combinations of the current image data DATn and the conversion image data $tDAT_{n-1}$ having gray levels, which correspond to a reference bit, belong to the second region "II." As shown in the drawing, when the conversion image data $tDAT_{n-1}$ has 4 bits and when its 1 MSB is the reference bit, correction values corresponding to combinations of the current image data DATn and the conversion image data $tDAT_{n-1}$ having gray levels greater than a gray level of 56 do not exist. Therefore, the combinations of the current image data DATn and the conversion image data $tDAT_{n-1}$ having the gray levels greater than the gray level of 56 belong to the second region "II."

Although not explicitly shown in FIG. 6, combinations of the conversion image data $tDAT_{n-1}$ and the current image data DATn having gray levels greater than the predetermined gray level also belong to the second region "II." As described above, when a gray level of the current image data DATn is greater than the predetermined gray level, the response time of liquid crystals to a gate voltage, which corresponds to the current image data DATn, reaches a satisfactory level. Thus, desired display quality can be achieved even without correcting the current image data DATn.

The data determiner 231 receives the conversion image data $tDAT_{n-1}$ and the current image data DATn, determines to which region of the LUT 241 a combination of the conversion image data $tDAT_{n-1}$ and the current image data DATn belongs, and determines whether to correct the current image data DATn.

When a combination of the conversion image data $tDAT_{n-1}$ and the current image data DATn belongs to the second region "II" which does not include a correction value corresponding to the combination, the data determiner 231 may output the current image data DATn as a display image signal DAT'n. When the combination of the conversion image data $tDAT_{n-1}$ and the current image data DATn belongs to the first region "I" which includes the correction value corresponding to the combination, the data determiner 231 outputs the current image data DATn and the correction value corresponding the combination to the data corrector 251. Then, the data corrector 251 corrects the current image data DATn by using the correction value to generate correction image data cDATn and outputs the correction image data cDATn as the display image signal DAT'n.

Accordingly, the data determiner 231 receives the conversion image data $tDAT_{n-1}$ and the current image data DATn and determines whether to correct the current image data DATn according to a region of the LUT 241 to which a combination of the conversion image data $tDAT_{n-1}$ and the current image data DATn belongs. According to the determination result of the data determiner 231, the current image data DATn or the correction image data cDATn is output as the display image signal DAT'n.

According to another exemplary embodiment of the present invention, correction values included in only the first region "I" may be stored in the LUT 241, thereby reducing the memory size of the LUT 241. In addition, when a combination of the conversion image data $tDAT_{n-1}$ and the current image data DATn belongs to the second region "II," the current image data DATn may be output as the display image signal DAT'n. In this way, the current image data DATn may be selectively corrected to reduce the power consumed to correct the current image data DATn.

Hereinafter, another exemplary embodiment of an LCD and another exemplary embodiment of a method of driving the same according to the present invention will be described with reference to FIG. 7.

The present exemplary embodiment of an LCD and the method of driving the same are different from those according to the previous exemplary embodiments in that previous image data $DAT_{n-1}$ is compared to current image data DATn and that conversion image data $tDAT_{n-1}$ is updated only when the previous image data $DAT_{n-1}$ is different from the current image data DATn. Elements substantially identical to those of the previous embodiments are indicated by like reference numerals, and thus their description will be omitted.

Figure 7:
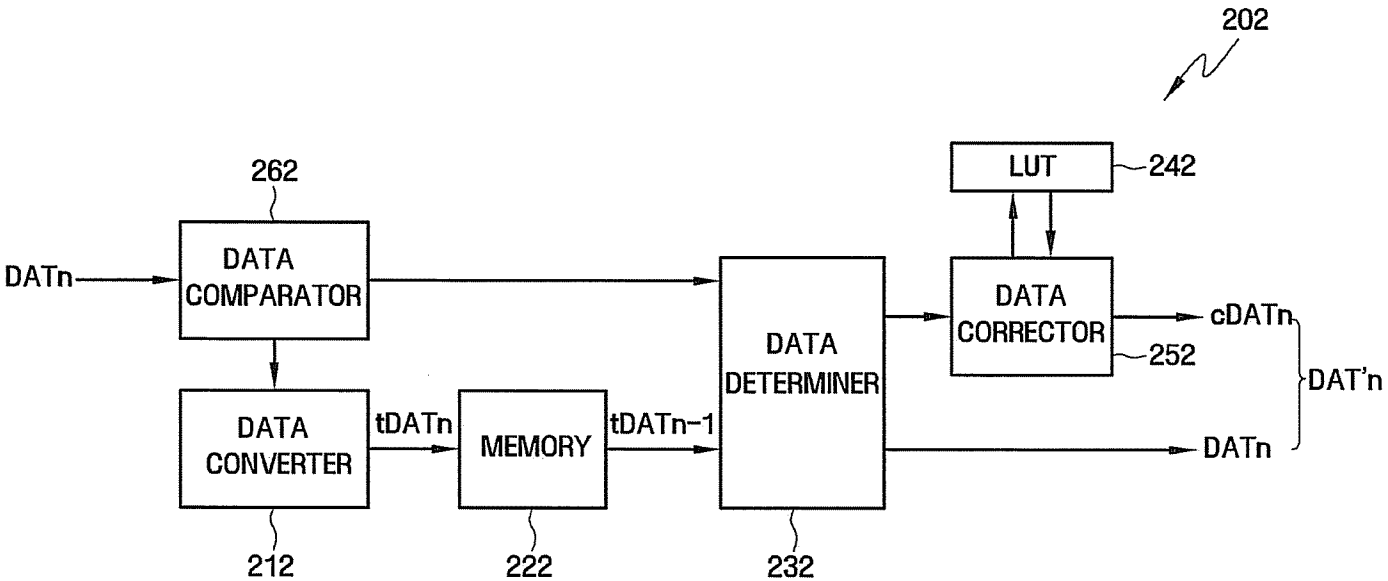
FIG. 7 is a block diagram of another exemplary embodiment of a timing controller included in an exemplary embodiment of an LCD according to the present invention.

Referring to FIG. 7, the timing controller 202 includes a data comparator 262 which receives the current image data DATn and compares the current image data DATn to the previous image data $DAT_{n-1}$ to determine whether they are identical. The data comparator 262 may include a memory (not shown) which stores the previous image data $DAT_{n-1}$.

The data comparator 262 compares the previous image data $DAT_{n-1}$ to the current image data DATn and, when they are different, transmits the current image data DATn to a data converter 212 to update a memory 222 with conversion image data tDATn. When the previous image data $DAT_{n-1}$ is identical to the current image data DATn, the data comparator 262 does not transmit the current image data DATn to the data converter 212. Instead, the data comparator 262 maintains the previous conversion data $tDAT_{n-1}$ stored in the memory 222 unchanged. That is, when there is no difference between the current image data DATn and the previous image data $DAT_{n-1}$, the previous image data $DAT_{n-1}$ stored in the memory 222 in the form of the conversion image data $tDAT_{n-1}$ need not be changed. Therefore, the memory 222 may be selectively updated only when the current image data DATn is different from the previous image data $DAT_{n-1}$. Consequently, the power consumed to update the memory 222 can be reduced.

A data determiner 232 determines whether to correct the current image data DATn by using the current image data DATn and the conversion image data $tDAT_{n-1}$ stored in the memory 222. Other elements of the present exemplary embodiment are substantially identical to those of the previous exemplary embodiments.

In the present exemplary embodiment of an LCD and the method of driving the same, since the conversion image data $tDAT_{n-1}$ having a smaller number of bits than that of the previous image data $DAT_{n-1}$ is stored in the memory 222, the size of the memory 220 can be reduced. In addition, since the memory 222 is updated only when the current image data DATn is different from the previous image data $DAT_{n-1}$, the power consumed to update the conversion image data $tDAT_{n-1}$ can be reduced.

Figure 8:
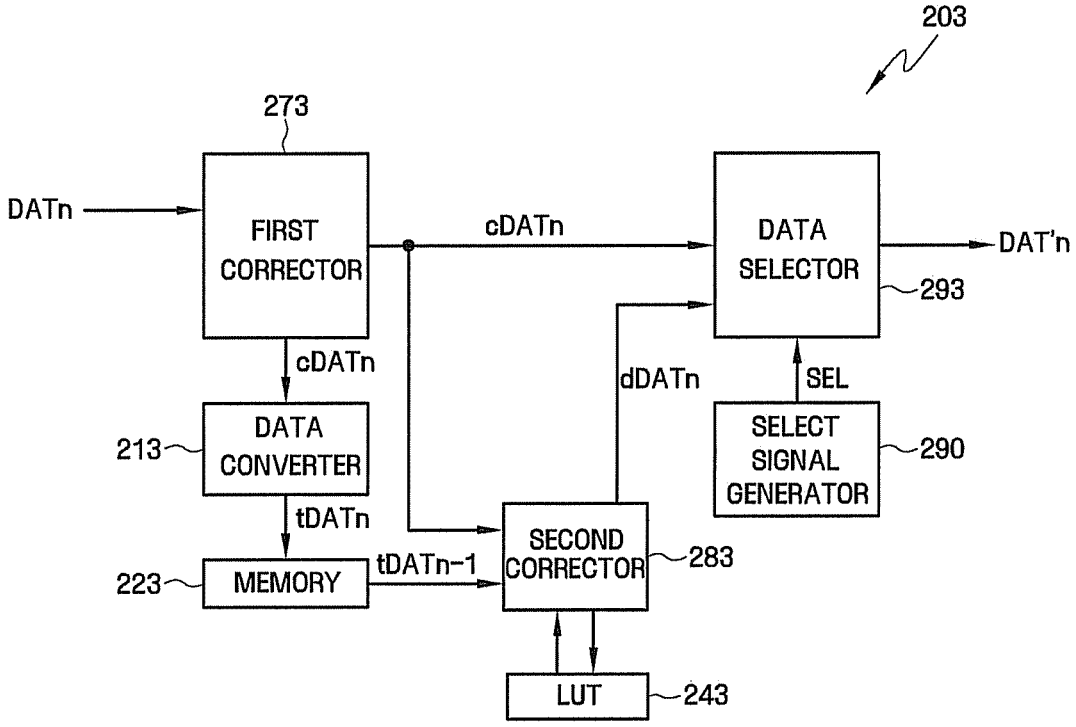
FIG. 8 is a block diagram of another exemplary embodiment of a timing controller included in an exemplary embodiment of an LCD according to the present invention.

Hereinafter, another exemplary embodiment of an LCD and a method of driving the same according to the present invention will be described with reference to FIG. 8. FIG. 8 is a block diagram of another exemplary embodiment of a timing controller 203 included in another exemplary embodiment of an LCD according to the present invention.

The present exemplary embodiment of an LCD and the method of driving the same are different from those according to the previous exemplary embodiments in that whether to correct first correction image data cDATn, which has already been corrected, is determined based on a reference bit of the first correction image data cDATn. Elements substantially identical to those of the previous exemplary embodiments are indicated by like reference numerals, and thus their description will be omitted.

Referring to FIG. 8, the timing controller 203 includes a first corrector 273, a data converter 213, a memory 223, a second corrector 283, an LUT 243, a data selector 293, and a select signal generator 290.

The first corrector 273 corrects current image data DATn and outputs current first correction image data cDATn to the data converter 213, the second corrector 283 and the data selector 293. Here, the first corrector 273 may perform gamma correction, e.g., contents-based adaptive brightness control ("CABC") on the current image data DATn. The gamma correction does not necessarily require the input of previous image data $DAT_{n-1}$ for image data correction. Instead, the gamma correction may be performed regardless of the previous image data $DAT_{n-1}$.

As described above, the current image data DATn is divided into first through third groups and includes an original reference bit. The first through third groups and the original reference bit may be maintained unchanged in the current first correction image data cDATn.

The data converter 213 receives the current first correction image data cDATn output from the first corrector 273 and converts the current first correction image data cDATn into conversion image data $tDAT_n$. The process of converting the current first correction image data cDATn into the conversion image data $tDAT_n$ and storing the conversion image data $tDAT_n$ in the memory 223 is substantially identical to the conversion process described above, and thus a detailed description thereof will be omitted. The memory 223 outputs a previous conversion image data $tDAT_{n-1}$ when it receives the current conversion data $tDAT_n$.

The second corrector 283 receives the current first correction image data cDATn output from the first corrector 273 and the previous conversion image data $tDAT_{n-1}$ output from the memory 223. Then, the second corrector 283 corrects the current first correction image data cDATn by using a correction value corresponding to a combination of the current first correction image data cDATn and the conversion image data $tDAT_{n-1}$ to generate current second correction image data dDATn and outputs the current second correction image data dDATn. The second corrector 283 may perform, for example, dynamic capacitance compensation ("DCC") in order to reduce the response time of liquid crystals. Here, the second corrector 283 may correct the current first correction image data cDATn by using the correction value which corresponds to the combination of the current first correction image data cDATn and the conversion image data $tDAT_{n-1}$ stored in the LUT 243 and may generate the current second correction image data dDATn.

The data selector 293 receives the current first correction image data cDATn and the current second correction image data dDATn and outputs any one of the current first correction image data cDATn and the current second correction image data dDATn as a display image signal DAT'n in response to a select signal SEL which is generated according to the reference bit of the conversion image data $tDAT_{n-1}$.

The select signal generator 290 generates the select signal SEL according to the reference bit of the previous conversion image data $tDAT_{n-1}$ and transmits the generated select signal SEL to the data selector 293. As shown in the drawing, the select signal generator 290 may be disposed independently and may receive the previous conversion image data $tDAT_{n-1}$ from the memory 223 through a separate connection (not shown). In some embodiments, the select signal generator 290 may be included in the second corrector 283 and share the conversion image data $tDAT_{n-1}$ provided by the second corrector 283. The above cases are merely exemplary embodiments, and the present invention is not limited thereto.

Accordingly, the current image data DATn is received and corrected to generate the current first correction image data cDATn. Then, the current first correction image data cDATn is converted into the conversion image data $tDAT_n$ and stored accordingly in the memory 223. The previous conversion image data $tDAT_{n-1}$ stored in the memory 223 and the current first correction image data cDATn are received by the second corrector 283, and the current first correction image data cDATn is corrected to generate the current second correction image data dDATn. In response to the select signal SEL generated according to the reference bit of the previous conversion image data $tDAT_{n-1}$, any one of the current first correction image data cDATn and the current second correction image data dDATn is output as the display image signal DAT'n. Whether to correct the current first correction image data cDATn is determined using the correction value which corresponds to the combination of the current first correction image data cDATn and the conversion image data $tDAT_{n-1}$ stored in the LUT 243. In some embodiments, whether to correct the current first correction image data cDATn may be determined based on the reference bit of the previous conversion image data $tDAT_{n-1}$.

In the present exemplary embodiment of an LCD and the method of driving the same, since the current image data DATn is corrected twice, the display quality of the LCD can be further enhanced. In addition, the first correction image data cDATn is converted into the conversion image data tDATn having a smaller number of bits than that of the first correction image data cDATn, and the conversion image data tDATn is stored in the memory 223. Thus, the size of the memory 223 can be reduced. Furthermore, whether to correct the current first correction image data cDATn is determined based on the conversion image data $tDAT_{n-1}$ which has been generated by using the previous first correction image data $cDAT_{n-1}$. Thus, errors due to data conversion can be reduced as compared to when first and second conversion processes are performed by using a signal into which the previous or current image data DATn before being corrected initially is converted.

While the present invention has been particularly shown and described with reference to exemplary embodiments thereof, it will be understood by those of ordinary skill in the art that various changes in form and detail may be made therein without departing from the spirit and scope of the present invention as defined by the following claims. The exemplary embodiments should be considered in a descriptive sense only and not for purposes of limitation.

What is claimed is:

1. A liquid crystal display comprising:

a liquid crystal panel;

a timing controller which receives previous image data and current image data, corrects or does not correct the current image data according to a reference bit of conversion image data generated using the previous image data, and outputs a display image signal to the liquid crystal panel; and a data driver which receives the display image signal and applies a data voltage corresponding to the display image signal to the liquid crystal panel, wherein each of the current image data and the previous image data is divided into a plurality of groups, each group having one or more bits, and any one of the groups comprises one or more original reference bits which are converted into the reference bit.

2. The liquid crystal display of claim 1, wherein the reference bit is a most significant bit of the conversion image data.

3. The liquid crystal display of claim 1, wherein the display image signal is generated using a correction value which corresponds to the conversion image data and the current image data.

4. The liquid crystal display of claim 3, wherein the correction value corresponding to the conversion image data and the current image data is stored in a lookup table(LUT) at a coordinate corresponding to a combination of the conversion image data and the current image data.

5. The liquid crystal display of claim 4, the current image data which is not listed in the LUT is corrected to a correction value by interpolation.

6. The liquid crystal display of claim 4, wherein the LUT is divided into a first region which comprises correction values corresponding to combinations of the conversion image data and the current image data and a second region which does not include the correction values corresponding to the combinations of the conversion image data and the current image data, wherein when the combination of the conversion image data and the current image data is within the second region, the display image signal is substantially the same as the current image data.

7. The liquid crystal display of claim 1, wherein the groups comprise first through third groups, and the first group comprises the original reference bits, wherein bits in the first group are combined with each other, bits in the second group are maintained unchanged, and bits in the third group are removed to generate the conversion image data.

8. The liquid crystal display of claim 7, wherein the first group comprises 2 bits, the second group comprises 3 bits, and the third group comprises 3 bits, wherein the 2 bits in the first group are combined into 1 bit, and the conversion image data is generated to be a 4-bit signal.

9. The liquid crystal display of claim 7, wherein the first group comprises 2 bits, the second group comprises 2 bits, and the third group comprises 2 bits, wherein the 2 bits in the first group are combined into 1 bit, and the conversion image data is generated to be a 3-bit signal.

10. The liquid crystal display of claim 1, wherein the previous image data is corrected to obtain previous first correction image data, and the current image data is corrected to obtain current first correction image data.

11. The liquid crystal display of claim 10, wherein the timing controller outputs one of the current first correction image data and current second correction image data obtained by correcting the current first correction image data as the display image signal in response to a select signal which is generated according to the reference bit of the conversion image data.

12. The liquid crystal display of claim 11, wherein the reference bit is the most significant bit of the conversion image data, and the display image signal is a first correction image signal when the select signal has a first level and a second correction image signal when the select signal has a second level.

13. The liquid crystal display of claim 11, wherein gamma correction is performed to correct the previous image data or the current image data, and dynamic capacitance compensation is performed to correct the current first correction image data.

14. A liquid crystal display comprising:

a liquid crystal panel;

a timing controller which receives previous image data and current image data, corrects or does not correct the current image data according to a reference bit of conversion image data generated using the previous image data, and outputs a display image signal to the liquid crystal panel, wherein the conversion image data is updated when the current image data is different from the previous image data and is not updated when the current image data is substantially identical to the previous image data; and a data driver which receives the display image signal and applies a data voltage corresponding to the display image signal to the liquid crystal panel, wherein each of the current image data and the previous image data is divided into a plurality of groups, each group having one or more bits, and any one of the groups comprises one or more original reference bits which are converted into the reference bit.

15. The liquid crystal display of claim 14, wherein the reference bit is a most significant bit of the conversion image data.

16. The liquid crystal display of claim 14, wherein the display image signal is generated using a correction value which corresponds to the conversion image data and the current image data.

17. The liquid crystal display of claim 16, wherein the correction value corresponding to the conversion image data and the current image data is stored in a lookup table(LUT) at a coordinate corresponding to a combination of the conversion image data and the current image data.

18. A method of driving a liquid crystal display, the method comprising:

receiving conversion image data, which is generated by using previous image data, and current image data;

outputting a display image signal which is generated by correcting or not correcting the current image data according to a reference bit of the conversion image data; and applying a data voltage corresponding to the display image signal to a liquid crystal panel and displaying an image corresponding to the data voltage on the liquid crystal panel, wherein each of the current image data and the previous image data is divided into a plurality of groups, each group having one or more bits, and any one of the groups comprises one or more original reference bits which are converted into the reference bit.

19. The method of claim 18, wherein the reference bit is a most significant bit of the conversion image data.

* * * * *